US005912077A

United States Patent [19]

Tamaru et al.

[11] Patent Number: 5,912,077

[45] Date of Patent: Jun. 15, 1999

[54] COTTON-LIKE MIXED MATERIALS, NON-WOVEN FABRICS OBTAINED THEREFROM AND PROCESS FOR PRODUCTION THEREOF

[75] Inventors: Shinji Tamaru; Katsutoshi Yamamoto; Jun Asano, all of Settsu, Japan

[73] Assignee: Daikin Industries, Ltd., Osaka, Japan

[21] Appl. No.: 08/809,843

[22] PCT Filed: Sep. 28, 1995

[86] PCT No.: PCT/JP95/01967

§ 371 Date: Apr. 1, 1997

§ 102(e) Date: Apr. 1, 1997

[87] PCT Pub. No.: WO96/10668

PCT Pub. Date: Apr. 11, 1996

[30] Foreign Application Priority Data

Oct. 4, 1994 [JP] Japan ..... 6-240430

[51] Int. Cl.[6] ..... D02G 3/00

[52] U.S. Cl. ..... 428/364; 442/59

[58] Field of Search ..... 442/59; 428/364

[56] References Cited

U.S. PATENT DOCUMENTS 5,562,986 10/1996 Yamamoto et al. ..... 428/364

FOREIGN PATENT DOCUMENTS

| | | |
|---|---|---|
| 46-11752 | 4/1971 | Japan . |
| 51-60773 | 5/1976 | Japan . |
| 61-132668 | 6/1986 | Japan . |
| 62-140615 | 6/1987 | Japan . |
| 7-501347 | 2/1995 | Japan . |

*Primary Examiner*—Johann Richter
*Assistant Examiner*—Joseph Murray
*Attorney, Agent, or Firm*—Kubovcik & Kubovcik

[57] ABSTRACT

The present invention provides cotton-like mixed materials containing the PTFE fibers and other fibers uniformly and being excellent in intermingling property, non-woven fabrics obtained from the cotton-like mixed materials, and a process for preparation thereof.

The split yarn having a network structure and obtained by splitting the uniaxially stretched PTFE film with the needle blade rolls in the stretched direction and the other continuous filament are fed simultaneously to the needle blade rolls rotating at high speed.

18 Claims, 6 Drawing Sheets

FIG. 7 (c)
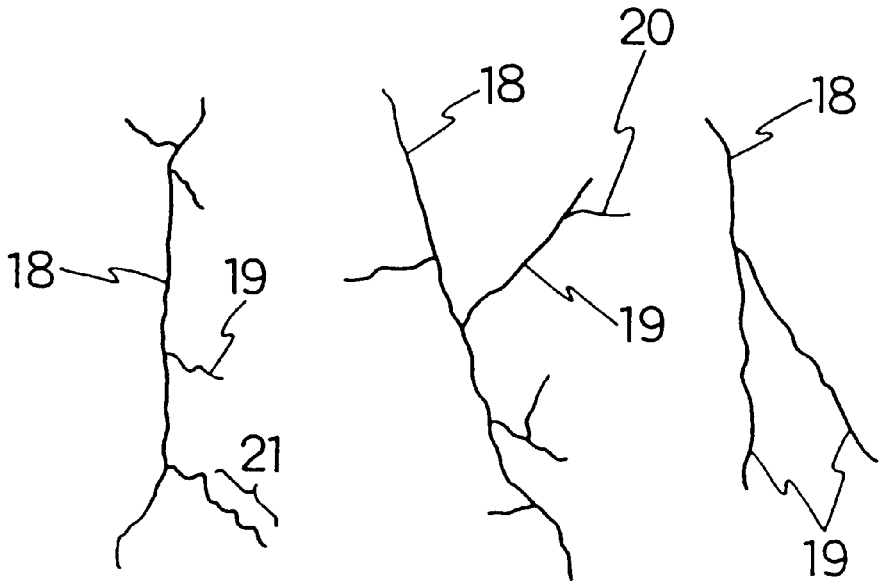
FIG. 7(a) FIG. 7(b)
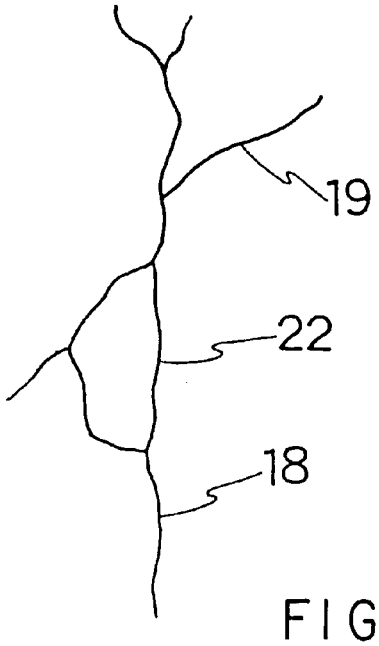
FIG. 7(d)

COTTON-LIKE MIXED MATERIALS, NON-WOVEN FABRICS OBTAINED THEREFROM AND PROCESS FOR PRODUCTION THEREOF

TECHNICAL FIELDS

The present invention relates to cotton-like mixed materials which contain polytetrafluoroethylene (PTFE) fibers and other fibers in the form of homogeneous mixture and having an excellent intermingling property, and relates to non-woven fabrics obtained therefrom and to a process for production thereof.

BACKGROUND ART

In recent years, non-woven fabrics comprising synthetic fibers, by making the best use of characteristics of those fibers, are extending their applications into various fields, such as clothing materials, medical materials, engineering and building materials, and materials for industrial use.

Among them, non-woven fabrics containing PTFE fibers are excellent in heat resistance, chemical resistance and abrasion resistance, and are expected to be further developed as highly functional non-woven fabrics.

Cotton-like PTFE materials being made into the non-woven fabrics are gathered PTFE fibers, and so far have been made in such manners as mentioned below:

(1) A process for producing continuous filaments and then cutting to a desired length.

The process for producing continued PTFE filaments is roughly classified into the following two processes.

(1*a*) An emulsion spinning method disclosed in U.S. Pat. No. 2,772, 444.

This method comprises extrusion spinning of an emulsion containing PTFE particles, a viscose binder, and the like and then sintering to obtain the filaments having a section of a given shape decided by a shape of a nozzle. Major problems of that method are such that a binder remains as a carbonaceous residual after sintering and the obtained PTFE filaments are colored in a dark brown, and that even if the carbonaceous residual is oxidized to be discolored, an original purity cannot be maintained. Further the method has a problem of increase in cost since complicated steps are employed.

(1*b*) A method disclosed in JP-B-22915/1961 or JP-B-8469/1973.

This method comprises stretching of fibers obtained by slitting a PTFE film to a desired width. A problem of this method is that the smaller the thickness of fibers obtained by making the slit width narrow is, the more easily the fibers are broken at the time of stretching.

PTFE fibers obtained by both methods (1*a*) and (1*b*) have such inherent properties of PTFE as a low friction coefficient and a high specific gravity, and therefore are not intermingled sufficiently with each other even if having been crimped (JP-B-22621/1975).

(2) A process for preparing PTFE fibrous powder in the form of a pulp and making a sheet-like material therefrom by paper making process (U.S. Pat. No. 3,003,912 and JP-B-15906/1969).

The method of the above-mentioned U.S. patent is to cut PTFE rod, cord or filament obtained by a paste extrusion, to a short length and to apply a shearing force to obtain fibrous PTFE powder.

JP-B-15906/1969 discloses a method for making fibers by applying a shearing force to the PTFE powder.

Any of the fibrous powder obtained by the above-mentioned methods can be made up to a sheet-like material by paper making process but cannot be made into a non-woven fabric by the use of a carding machine, needle punching machine, or the like as they are short in fiber length and in the form of a pulp.

Also as a process for producing a mixture of split yarns and other fibers, a process for making them into a cotton-like material simultaneously with a combing roll was proposed (JP-B-35093/1989). In that process, since a large amount of short fibers are produced (specification of Japanese Patent Application No. 78364/1993), there is a problem that in a step for making those webs into non-woven fabrics through needle punching method or water jet needling method, there is a large amount of short fibers which cannot be intermingled, which causes a not-negligible economical loss.

Therefore, cotton-like materials having PTFE fibers and other fibers obtained with a combing roll have been limited to thermal bonding non-woven fabrics which do not cause losses of even the short fibers by coating the surface of PTFE fibers with thermofusing resin layer or employing fibers for thermal bonding as the other fibers.

An object of the present invention is to provide cotton-like mixed materials having branched structure and/or loop structure (hereinafter may be referred to as "branched structure"), being excellent in intermingling property and comprising PTFE fibers and other fibers, and to provide non-woven fabrics produced thereof.

Another object of the present invention is to provide non-woven fabrics which exhibit particularly excellent characteristics of PTFE (heat resistance, chemical resistance, low friction property, electric insulation property, water-repelling property, mold releasing property and the like) and excellent characteristics of other fibers, and, as the case may be, offer an economical effect of lowering price thereof.

Yet another object of the present invention is to provide cotton-like mixed materials produced by simultaneously mixing PTFE fibers having the branched structure and other fibers, and non-woven fabrics produced thereof.

DISCLOSURE OF THE INVENTION

The present invention relates to cotton-like mixed materials comprising polytetrafluoroethylene fibers having branched structure and/or loop structure and other fibers.

In the present invention, it is preferable that the proportion of the above-mentioned other fibers is from 10 to 90% by weight.

Also in the present invention, it is preferable that the above-mentioned other fibers comprise at least two kinds of fibers.

Also in the present invention, it is preferable that the above-mentioned other fibers are inorganic fibers.

Also, in the present invention, it is preferable that the above-mentioned inorganic fibers are carbon fibers, glass fibers and/or metal fibers.

Also in the present invention, the above-mentioned other fibers are heat resistive synthetic fibers.

Also in the present invention, it is preferable that the above-mentioned heat resistive synthetic fibers are poly (phenylene sulfide) fibers, polyimide fibers, para-linked aramid fibers, meta-linked aramid fibers, phenolic fibers, polyarylate fibers and/or carbon fibers.

Also in the present invention, it is preferable that the above-mentioned heat resistive synthetic fibers are fluorine-containing resin fibers including tetrafluoroethylene-perfluoro(alkyl vinyl ether) copolymer fibers, tetrafluoroethylene-hexafluoropropylene copolymer fibers, ethylene-tetrafluoroethylene copolymer fibers, poly(vinyl fluoride) fibers, poly(vinylidene fluoride) fibers, polychlorotrifluoroethylene fibers or ethylene-chlorotrifluoroethylene copolymer fibers.

Also in the present invention, it is preferable that the above-mentioned other fibers are polyolefin fibers comprising polyethylene fibers and/or polypropylene fibers.

Also in the present invention, it is preferable that the above-mentioned other fibers are polyester fibers including polyethylene terephthalate fibers and/or polybutylene terephthalate fibers.

Also in the present invention, it is preferable that the above-mentioned other fibers are natural fibers.

Also in the present invention, it is preferable that thermofusing resin layer is provided on at least a part of the surface of the above-mentioned polytetrafluoroethylene fibers.

Also the present invention relates to non-woven fabrics made of any of the above-mentioned cotton-like mixed materials.

Further the present invention relates to a process for production of cotton-like mixed materials which is characterized by simultaneous feeding of a continuous filament tow other than PTFE fibers, a sliver in a spinning step or at least two thereof and a polytetrafluoroethylene film uniaxially stretched at least three times or a yarn produced by splitting the above-mentioned uniaxially stretched film into the form of net, to needle blade rolls rotating at high speed (these needle blade rolls are provided with thicker needles as compared with a pair of needle blade rolls for the purpose of splitting, and the number of needles thereof is small).

Further in the present invention, it is preferable that thermofusing resin layer is provided on at least a part of the surface of the above-mentioned polytetrafluoroethylene film, and that the above-mentioned uniaxial stretching is conducted at a temperature of not less than the melting point of the thermofusing resin.

Further in the present invention, it is preferable that the above-mentioned thermofusing resin layer is provided by laminating a thermofusing resin film.

Further the present invention relates to a process for production of felt-like non-woven fabrics, characterized in that the fibers in the cotton-like mixed materials obtained through the above-mentioned production process are intermingled with each other by needle punching or water jet needling.

Further the present invention relates to a process for production of non-woven fabrics which are less in falling of fibers, characterized in that a part of fibers in the cotton-like mixed materials containing the thermofusing resin and obtained through the above-mentioned production process is subjected to thermal bonding.

BRIEF DESCRIPTION OF THE DRAWINGS

FIG. 7 is a diagrammatic view showing the branched structure and the loop structure of the PTFE fibers of the present invention.

BEST MODE FOR CARRYING OUT THE INVENTION

Figure 1:
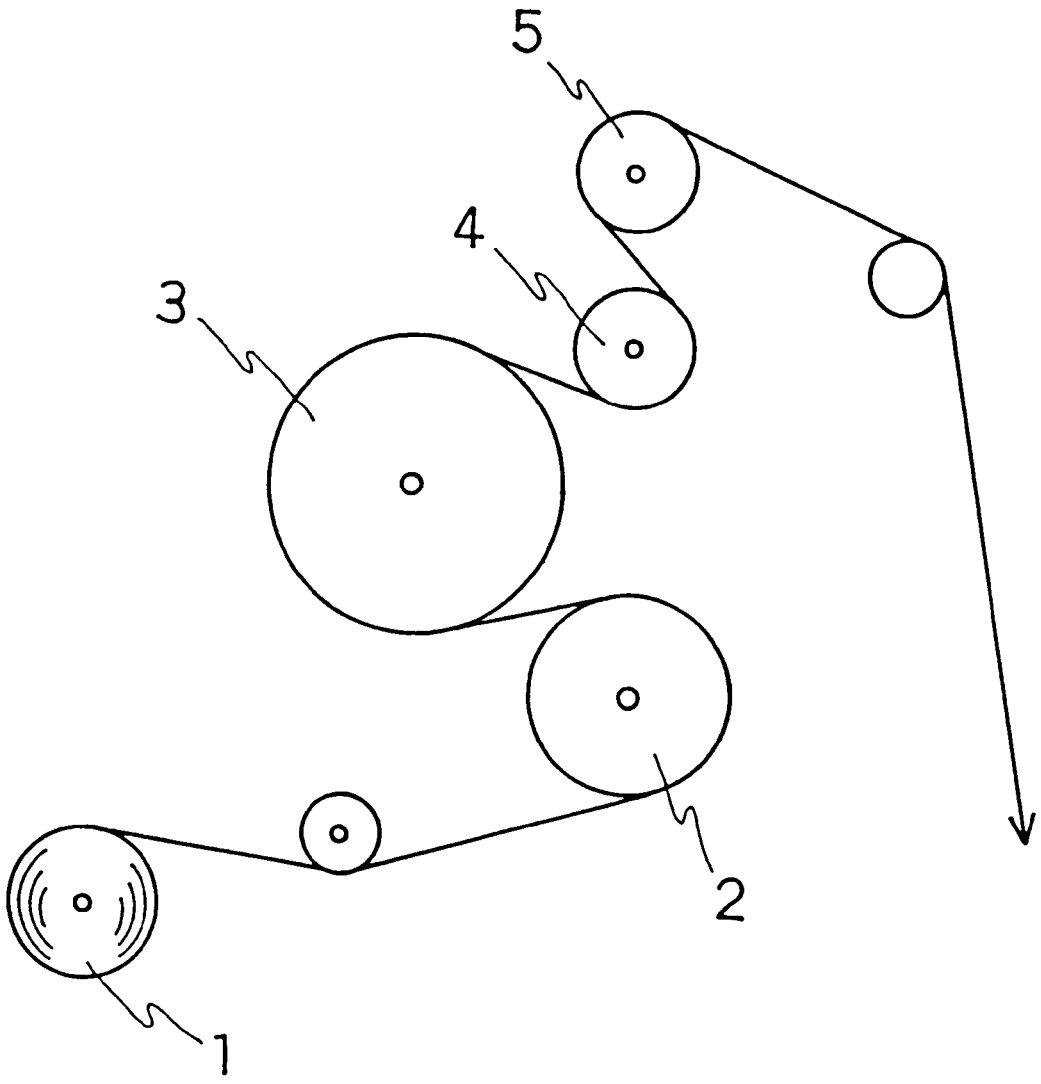
FIG. 1 is an explanatory view of the uniaxial stretching machine in the present invention.

The major feature of the present invention is to obtain cotton-like mixed materials, in which to the needle blade rolls rotating at high speed are fed simultaneously a uniaxially stretched polytetrafluoroethylene (PTFE) film or a yarn obtained by splitting the uniaxially stretched PTFE film and a bundle (tow) of one or more of other long filaments or sliver produced during spinning step, thereby making PTFE into PTFE fibers having the branched structure and/or loop structure and at the same time, making the other filaments into staple fibers or opening each fiber of the sliver, and thus mixing the respective fibers with each other.

In the present invention, cotton-like mixed materials excellent in thermal bonding property can be obtained by employing, as the above-mentioned PTFE film, one which is provided with a thermofusing resin film on at least a part of the surface thereof.

Further, another feature of the present invention is such that characteristics of the respective fibers are exhibited by making non-woven fabrics from the cotton-like mixed materials comprising those fibers.

For example, in the case of the non-woven fabrics comprising meta-linked aramid fibers which have not been subjected to surface treatment, water dropped thereon permeates there immediately. However, by mixing PTFE fibers in the non-woven fabrics, the dropped water are repelled to form water droplets. From the aspect of the PTFE fibers having the branched structure and/or loop structure, in case of using PTFE only, unless the web is subjected to antistatic treatment, a trouble is easy to occur in folding with a cross-lapper (equipment for folding the web) due to occurrence of static electricity. However if meta-linked aramid fibers are mixed, such a trouble does not occur and as a whole, process controlling becomes easy, and also intermingling property of the fibers in the needle-punched non-woven fabrics can be enhanced.

The other fibers of the present invention are inorganic fibers, heat resistive synthetic fibers, fluorine-containing resin fibers, polyolefin fibers, polyester fibers, natural fibers or at least two thereof.

The mixing amount of the above-mentioned other fibers is from 10 to 90% by weight, preferably from 10 to 75% by weight, more preferably from 15 to 75% by weight. If the amount is less than 10% by weight, there is a tendency that intermingling property is not improved and the other fibers merely exist as foreign materials. If the amount exceeds 90% by weight, characteristics of PTFE tend not to be exhibited.

The purpose of using at least two kinds of the other fibers is to make non-woven fabrics conforming to end uses by varying properties of the non-woven fabrics such as intermingling strength, apparent density and air permeability, and endowing the fabrics with electric conductivity.

Examples of the above-mentioned inorganic fibers are, for instance, carbon fibers, glass fibers, metal fibers, asbestos, rock wools and the like. From the viewpoint of fiber length, carbon fibers, glass fibers and metal fibers are preferable.

Examples of the above-mentioned metal fibers are, for instance, stainless steel fibers, copper fibers, steel fibers and the like. From the viewpoint of corrosion resistance, stainless steel fibers are preferable.

Preferred examples of the above-mentioned heat resistive synthetic fibers are, for instance, poly(phenylene sulfide) (PPS) fibers, polyimide (PI) fibers, para-linked aramid fibers, meta-linked aramid fibers, phenolic fibers, polyarylate fibers, carbide fibers and fluorine-containing resin fibers.

Preferred examples of the above-mentioned fluorine-containing resin fibers are, for instance, tetrafluoroethylene-perfluoro(alkyl vinyl ether) copolymer (PFA) fibers, tetrafluoroethylene-hexafluoropropylene copolymer (FEP) fibers, ethylene-tetrafluoroethylene copolymer (ETFE) fibers, poly(vinyl fluoride) (PVF) fibers, poly(vinylidene fluoride) (PVdF) fibers, polychlorotrifluoroethylene (PCTFE) fibers, ethylene-chlorotrifluoroethylene copolymer (ECTFE) fibers and the like.

Examples of the above-mentioned polyolefin fibers are, for instance, polyethylene fibers, polypropylene fibers, nylon fibers, urethane fibers and the like. From the viewpoint of purity, polyethylene fibers and polypropylene fibers are preferable.

Examples of the above-mentioned polyester fibers are, for instance, polyethylene terephthalate fibers, polybutylene terephthalate fibers and the like. From economical point of view such as production in industrial scale, polyethylene terephthalate fibers are preferable.

Examples of the above-mentioned natural fibers are, for instance, wool, cotton, cashmere, angora wool, silk, jute, pulp and the like. From the viewpoint of necessary fiber length for intermingling, wool and cotton are preferable.

As the PTFE used in the present invention, there are, for example, those obtained through paste extrusion molding of PTFE fine powder (PTFE fine powder obtained by emulsion polymerization) or those obtained through compression molding of PTFE molding powder (PTFE powder obtained by suspension polymerization). The molded PTFE are preferably in such a form as film, tape, sheet and ribbon. A thickness thereof is 5 to 300 $\mu$m, preferably 5 to 150 $\mu$m in order to conduct a stable stretching. A PTFE film can be obtained by calendering the extrudate molded by paste extrusion of PTFE fine powder or cutting a compression-molded article produced from molding powder.

For example, the PTFE film to be uniaxially stretched is preferably semi-sintered or sintered one. The semi-sintered PTFE is obtained by heat-treating the unsintered PTFE at a temperature between the melting point (about 327° C.) of the sintered PTFE and the melting point (about 337° C. to about 347° C.) of the unsintered PTFE. A crystalline conversion ratio of the semi-sintered PTFE is from 0.10 to 0.85, preferably from 0.15 to 0.70.

The crystalline conversion ratio of the semi-sintered PTFE article is defined as follows:

First, 10.0±0.1 mg of a sample of the semi-sintered PTFE is produced. Since the sintering proceeds from the surface toward the inner portion, the degree of the semi-sintering of the article is not necessarily homogeneous throughout the article, and the semi-sintering is less homogeneous in a thicker article than in a thinner one. In the preparation of the sample, it is, therefore, to be noted that various portions having various degrees of semi-sintering in the thickness direction must be sampled uniformly. By using the thus produced samples, at first the crystalline melting chart is made by the following method.

The crystalline melting chart is recorded by means of a DSC (DSC-2 of Perkin-Elmer). First, the sample of the unsintered PTFE is charged in an aluminum-made pan of the DSC, and the heat of fusion of the unsintered PTFE and that of the sintered PTFE are measured as follows:

(1) The sample is heated to 277° C. at a heating rate of 160° C./min and then from 277° C. to 360° C. at a heating rate of 10° C./min.

A position where an endothermic curve appears in this step is defined as "a melting point of the unsintered PTFE or PTFE fine powder".

(2) Immediately after heating to 360° C., the sample is cooled to 277° C. at a cooling rate of 80° C./min and (3) Again the sample is heated to 360° C. at a heating rate of 10° C./min.

A position where an endothermic curve appears in the heating step (3) is defined as "a melting point of the sintered PTFE".

The heat of fusion of the unsintered or sintered PTFE is proportional to the area between the endothermic curve and a base line. The base line is a straight line drawn from a point on the DSC chart at 307° C. (580° K) to the right-hand foot of the endothermic curve.

Secondly, a crystalline melting chart for the semi-sintered PTFE is recorded following the step (1).

Then, the crystalline conversion is defined by the following equation:

$$\text{Crystalline conversion}=(S_1-S_3)/(S_1-S_2)$$

wherein $S_1$ is the area of the endothermic curve of the unsintered PTFE, $S_2$ is the area of the endothermic curve of the sintered PTFE and $S_3$ is the area of the endothermic curve of the semi-sintered PTFE.

The crystalline conversion of the semi-sintered PTFE article of the present invention is from 0.10 to 0.85, preferably from 0.15 to 0.70.

The sintered PTFE can be obtained by heat-treating the unsintered PTFE or semi-sintered PTFE at a temperature of not less than the melting point of the unsintered PTFE.

The uniaxial stretching of the present invention can be carried out, for example, by using an equipment shown in FIG. 1 or by the conventional methods such as stretching between the two rolls which have been heated to usually about 250° to 320° C. and have different rotation speeds. In the above-mentioned FIG. 1, numeral 1 is a long un-stretched film, numeral 2 is a heating roll (320° C., peripheral speed: 0.25 m/min), numeral 3 is a heating roll (320° C., peripheral speed: 1.0 m/min) and numerals 4 and 5 are heating rolls (340° C., peripheral speed: 1.0 m/min). It is preferable that the stretching ratio is changed depending on the degree of sintering, and is at least 6 times, preferably not less than 10 times in the case of the semi-sintered PTFE, and at least 3 times, preferably not less than 3.5 times in the case of the sintered PTFE. This is because the orientation of the semi-sintered PTFE is necessary to be increased by stretching since the tearing property of the semi-sintered PTFE in the longitudinal direction is worse as compared to that of the sintered PTFE. Also in order to obtain fine fibers, it is desirable to stretch at as high ratio as possible, but the attainable stretching ratio is usually about 10 times in the case of the sintered PTFE, and about 30 times in the case of the semi-sintered PTFE.

In case of a too low stretching ratio, there occurs a trouble that the film is intermingled with the blades of the needle blade rolls for splitting.

The thickness of the uniaxially stretched PTFE film is preferably from 1 to 100 $\mu$m, particularly preferably from 1 to 50 $\mu$m after uniaxial stretching. If the thickness is more than 100 $\mu$m, split yarns obtained by splitting, long fibers and cotton-like materials become rigid, and feeling of products obtained therefrom becomes worse. The uniaxially stretched PTFE film having a thickness of less than 1 $\mu$m is difficult to produce industrially.

In the case of the semi-sintered PTFE and the sintered PTFE, an additional heat treating after the uniaxial stretching can prevent the shrinkage, due to a heat, of the split yarns and the fibers obtained after the splitting and maintain bulkiness. Particularly in the case of the cotton-like materials, lowering of air permeability can be prevented. The heat treating temperature can be selected from the temperature range of not less than the temperature at uniaxial stretching, usually not less than 300° C. and, if necessary, in the range up to about 380° C.

The thus obtained PTFE film uniaxially stretched can be fed to the next step as it is, and preferably the film is splitted into the net-like form in the stretching direction by needle blade rolls.

There are, for example, the following means for splitting.

The uniaxially stretched PTFE film is passed through at least a pair of rotating needle blade rolls for splitting to obtain net-like structure. For splitting, an equipment described, for example, in JP-A-180621/1983 can be employed.

This equipment described in JP-A-180621/1983 has a pair of needle blade rolls. The present invention can be also executed by using one needle blade roll as described in JP-B-1371/1977, but the splitting conditions are limited. For example, in case where the splitting is conducted from one side of the stretched film with one needle blade roll, when the number of needles of the needle blade roll is increased (when the split width is narrowed), the points of the needle are difficult to bore into the film and the splitting cannot be conducted particularly at the edges (ears) of the film, whereas it depends on the film thickness and stretching ratio. In this point, the film can be split uniformly up to its edges by using a pair of needle blade rolls engaged with each other. The preferred embodiment is explained in accordance with FIG. 2.

Figure 2:
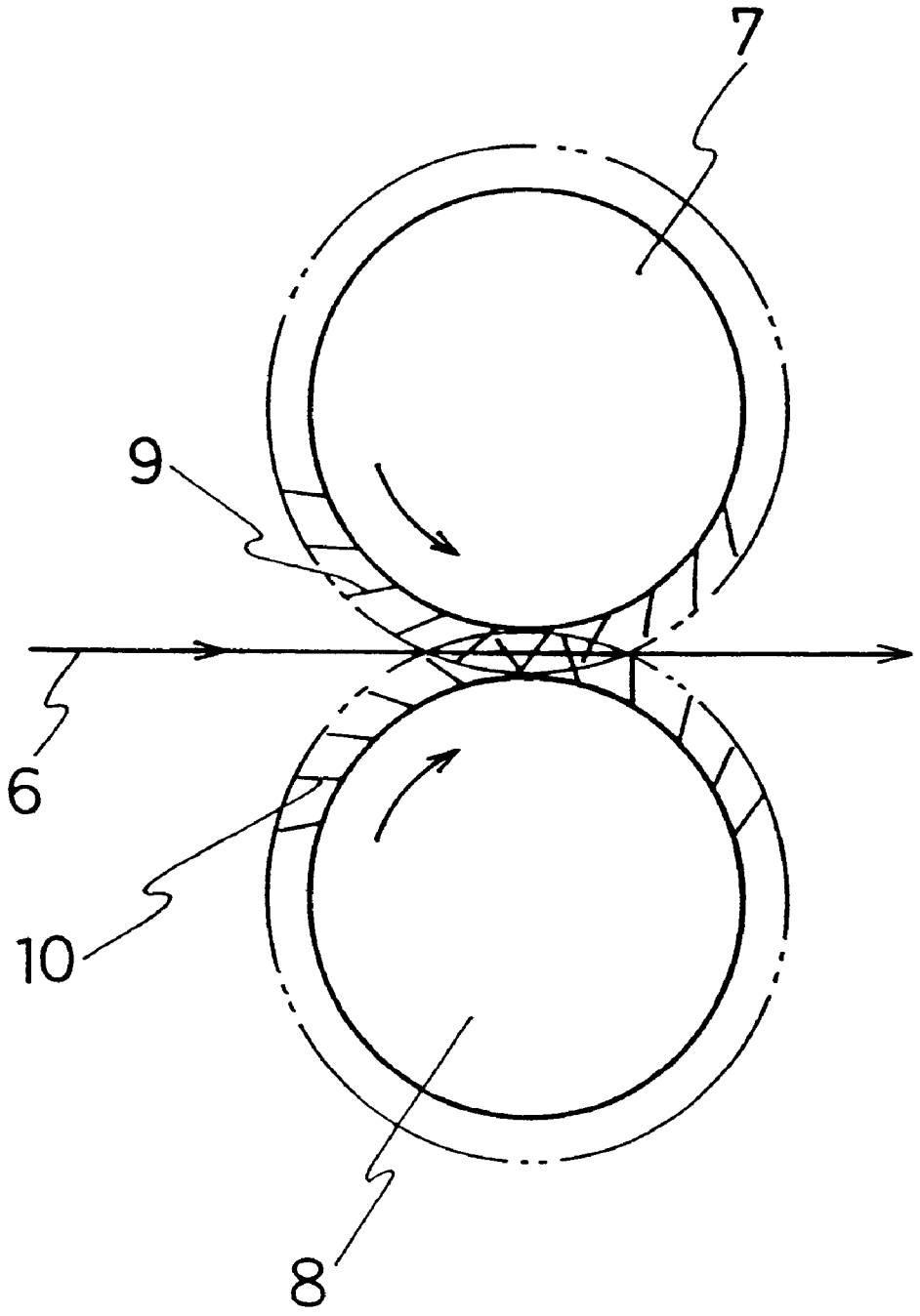
FIG. 2 is an explanatory view of the needle blade rolls of the split machine in the present invention.

In FIG. 2, numeral 6 is a uniaxially stretched PTFE film, which is fed to a pair of the needle blade rolls 7 and 8 by means of a transfer means (not illustrated). At the rear side of the rolls 7 and 8, there is provided the receiving means (not illustrated). The film 6 passes between the needle blade rolls 7 and 8, and during passing therebetween, the film is split with the needle blades 9 and 10 provided on the outer surfaces of the needle blade rolls 7 and 8. The split film is collected in the receiving means.

The rotation speed and direction of the needle blade rolls, the film feed speed and the angle of needles can be optionally selected, and in the present invention, it is preferable that the film feeding direction is the same as the rotation direction of the roll.

It is preferable that the relation of the uniaxially stretched PTFE film feed speed (V1) and the needle blade roll rotation speed (peripheral speed (V2)) is V2>V1. In that case, the pattern of the network structure is usually a geometrical pattern made by a difference in the speed of the needle blades passing the surfaces of the film. If V2 is exceedingly higher than V1, the pattern does not become the net-like structure and the film is fibrillated (becoming staple fibers).

Figure 3:
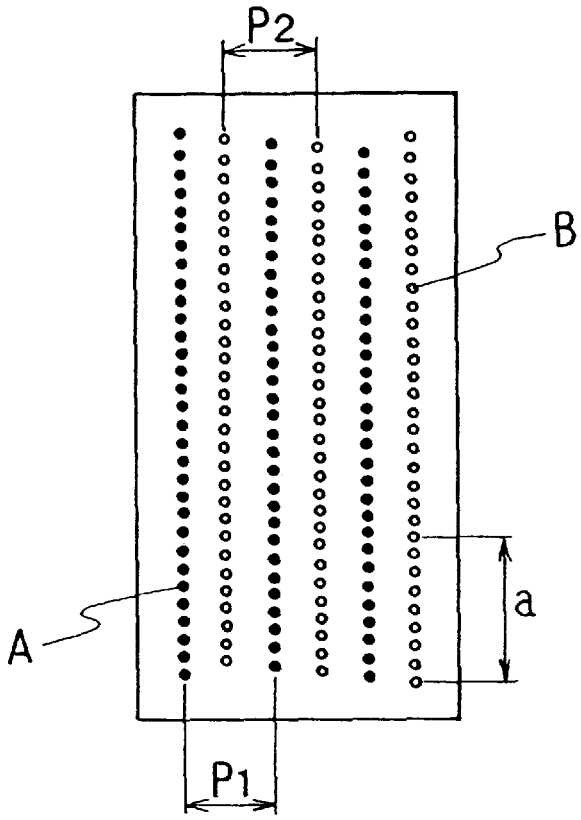
FIG. 3 is an explanatory view showing an example of arrangement of needle blades on the surface of the needle blade rolls shown in FIG. 2.

With respect to the shape of the needle blade rolls and the engagement of the blades of the upper and lower needle blade rolls, when the film was passed at a speed equal to the rotation speed of a pair of the upper and lower needle blade rolls shown in FIG. 2, the needling pattern shown in FIG. 3 was obtained. In FIG. 3, A is a needled hole of the upper needle blade roll, and the pitch (P1) in the circumferential direction was 2.5 mm. B is a needled hole of the lower needle blade roll, and the pitch (P2) was 2.5 mm like P1. The number of needles "a" in the longitudinal direction of the needle blade roll was 13 needles per 1 cm.

Figure 4:
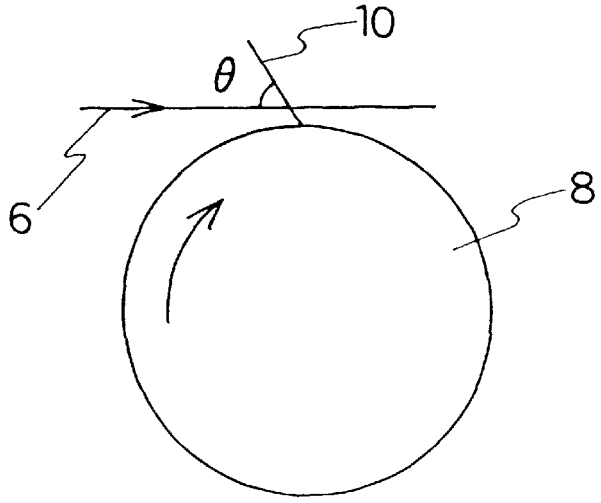
FIG. 4 is an explanatory view explaining an angle (θ) of a needle of the needle blade shown in FIG. 2.

An angle (θ) of needle is preferably 45 to 90°, particularly preferably 50 to 70° to the running direction of the film as shown in FIG. 4.

The arrangement, the number, the length, the diameter and the angle of needle blades 9 and 10 of the needle blade rolls 7 and 8 may be properly defined in consideration of a thickness of the fibers intended to be obtained. It is preferable that the blades are usually arranged at a row in the longitudinal direction of the roll, the number of blades is 20 to 100/cm$^2$ and the angle of needles is 50 to 70°, but the arrangement, the number and the angle are not limited thereto. Also the mounted conditions of the needle blades of the rolls 7 and 8 may be the same or different. The distance between the needle blade rolls 7 and 8 may also be properly adjusted. The preferable distance is usually such that the needles overlap by about 1 to 5 mm at the end thereof.

Figure 5:
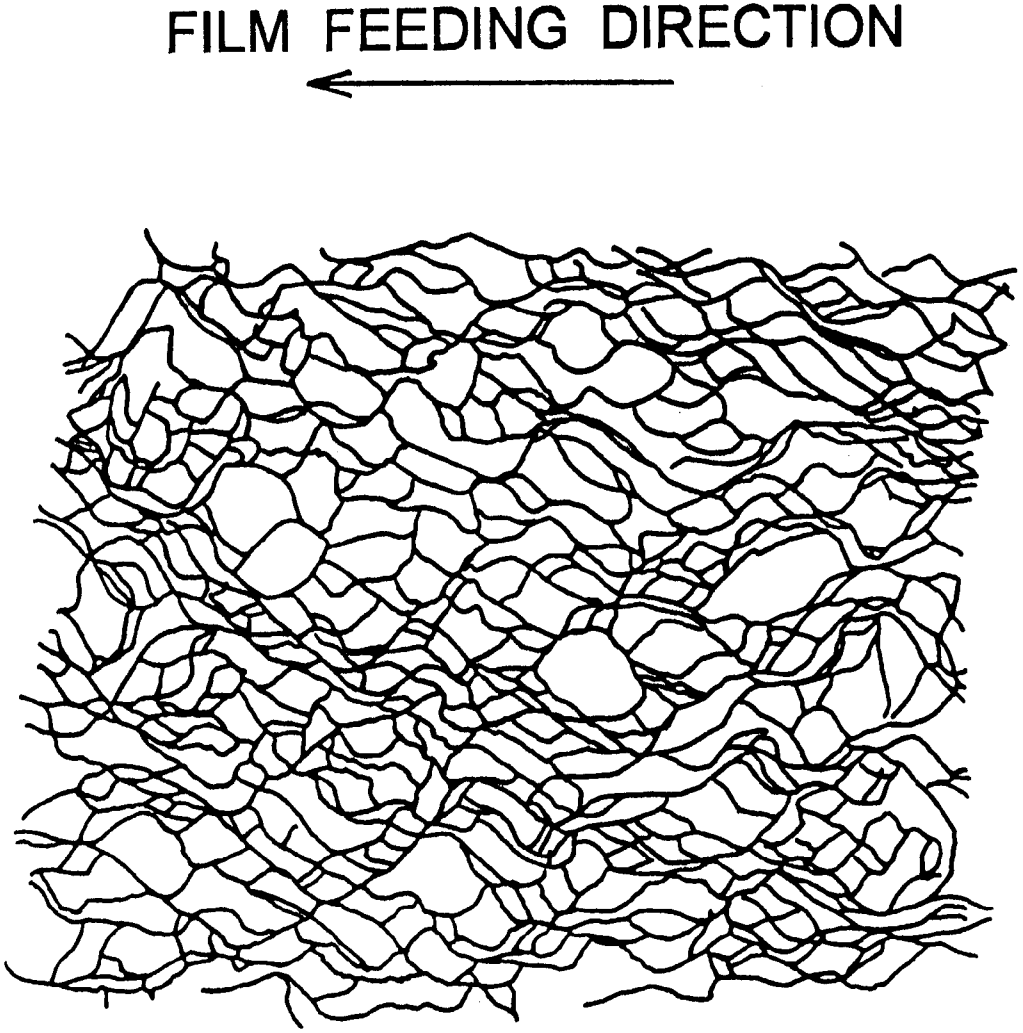
FIG. 5 is a diagrammatic view showing split yarns in the spreaded form of the present invention.

The above-mentioned net-like structure is such that the uniaxially stretched PTFE film is not split into separate fibers and when spread in the widthwise direction (a direction at a right angle to the film feeding direction) of the film after splitting, the film becomes net-like as shown in FIG. 5. In order to obtain such a network structure, the relation of the feed speed of the uniaxially stretched PTFE film and the rotation speed of the needle blade rolls, and the arrangement and the number of needles of the needle blade rolls may be properly selected.

In order to simultaneously mix the uniaxially stretched PTFE film or its split yarn and the other fibers, the apparatus described in JP-B-35093/1989 can be used. The present inventors have found that the method by using a combing roll disclosed therein can produce directly PTFE staple fibers (relatively short fibers) and cotton-like PTFE materials by tearing and opening the uniaxially stretched PTFE film by applying mechanical force, and filed a patent application therefor (Japanese Patent Application No. 78264/1993). The PTFE staple fibers obtained by that method contain bulky fibers excellent in intermingling property and also a lot of short fibers not contributing to intermingling, and have a problem that in a carding step for producing non-woven fabrics, those short fibers drop, which results in decreasing in yield.

Figure 6:
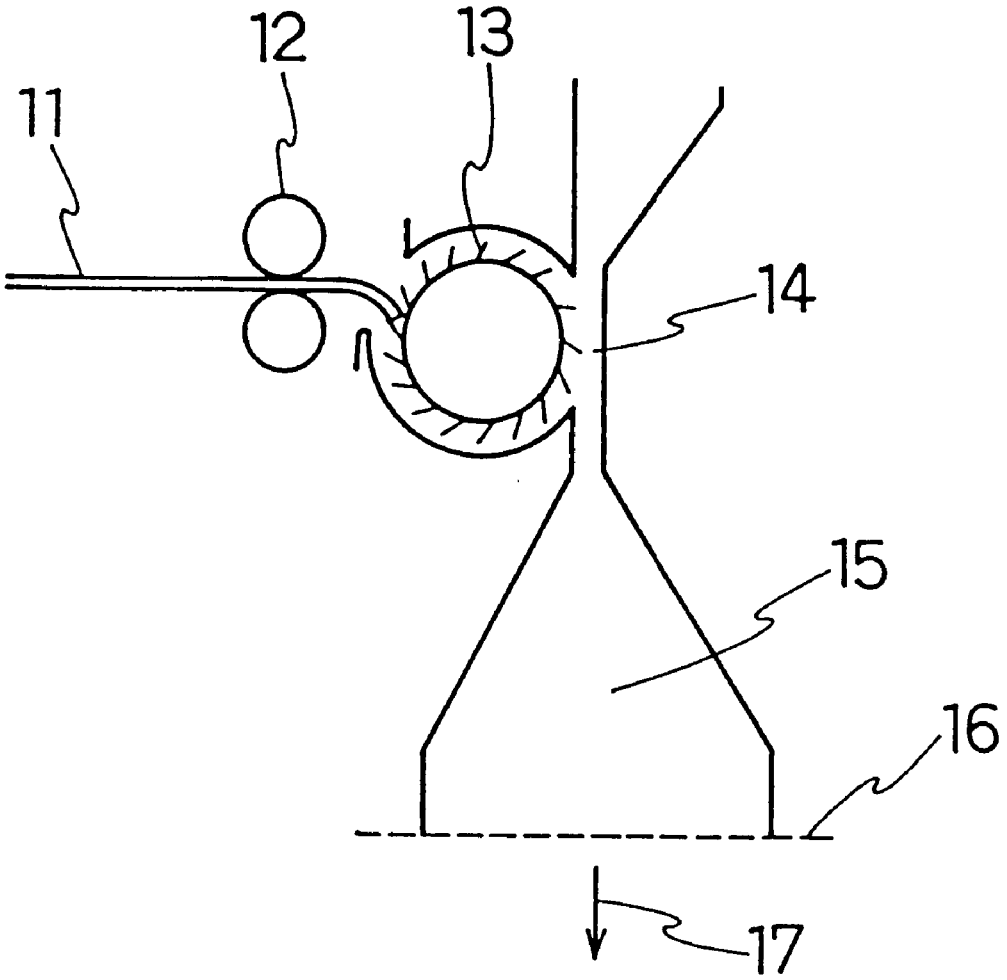
FIG. 6 is an explanatory view of the equipment for mixing PTFE fibers and other fibers of the present invention.

FIG. 6 shows an apparatus for mixing the PTFE fibers and the other fibers. Numeral 11 designates a feeding material, numeral 12 designates pinch rolls (feeding speed: 1.5 m/min), numeral 13 designates a needle blade roll (diameter of needle point: 100 mm, needle length: 200 mm, the number of needles: 30420, rotation speed: 3000 rpm), numeral 14 designates a direct air flow, numeral 15 designates a convection air flow, numeral 16 designates a mesh and numeral 17 designates a suction blower.

The cotton-like mixed materials, which is produced by mixing the PTFE fibers having the branched structure and/or loop structure and the other fibers with the needle blade roll 13 rotating at high speed as shown in FIG. 6, are preferable from a point that such materials are composed mostly of fibers useful for intermingling even in the carding step which is typical for making non-woven fabrics.

The branched structure and loop structure can be illustrated as shown in FIG. 7. The fiber (a) has a branched structure comprising a fiber 18 and a plurality of branches 19 coming from the fiber 18. The fiber (b) is a fiber having a branch 19 and further a branch 20 coming from the branch 19. The fiber (c) is a fiber simply divided into two branches. The fiber (d) is a fiber having a loop 22. Those structures are only models of the fibers, and the fibers having the same structure are not found actually, which is one of the important features in the present invention. The number and the length of branches are not particularly limited, but the existence of such branches or loops is an important cause of enhancing intermingling property of the fibers. It is preferable that there is one branch or one loop, particularly at least two branches or at least two loops per 5 cm of the fiber.

It is preferable that the PTFE fibers making the cotton-like mixed materials of the present invention have a branched structure or a loop structure; fineness thereof is 2 to 200 deniers, preferably 2 to 50 deniers, further preferably 2 to 30 deniers, particularly preferably from 2 to 15 deniers; the number of crimps is 1 to 15/20 mm; and the figure of section of the fibers is not regular. The preferable cotton-like mixed materials are obtained when the fineness of the fiber including branches is in the said range, though there is no fiber having the same fineness throughout the fiber. Therefore there is a case where a part of the fiber is out of the above-mentioned range of the fineness. Also in the cotton-like mixed materials of the present invention in order not to make intermingling property worse, it is preferable that the content of the fibers having a fineness of more than 200 deniers is minimized below 10%, particularly below 5%.

Also it is preferable that as shown in FIG. 7, the fiber 18 making the cotton-like mixed materials of the present invention has partly a "crimp" 21. The "crimp" also contributes to enhancement of intermingling property. The preferable number of crimps is 1 to 15/20 mm. According to the process of production of the present invention, crimps arise even if no specific crimping process is applied.

The PTFE fibers of the present invention have the branched structure or the loop structure as mentioned above, and therefore, have intermingling property with various other fibers. Those PTFE fibers can be obtained, for example, by uniaxially stretching a PTFE film, splitting into the net-like form and then cutting, and further the cotton-like mixed materials can be obtained from the PTFE fibers.

In order to obtain, from the above-mentioned PTFE fibers, non-woven fabrics which are less in falling of fibers, it is necessary to impart thermal bonding property to the PTFE fibers, and a thermofusing resin layer may be provided on at least a part of the PTFE fiber. Such a layer can be provided, for example, by laminating a film comprising the thermofusing resin, uniaxially stretching at a temperature of not less than the melting point of the thermofusing resin, splitting into the net-like form and then cutting, thus cotton-like mixed materials comprising the PTFE fibers having thermal bonding property can be obtained and further non-woven fabrics can be produced therefrom by using the above-mentioned thermal bonding property.

The above-mentioned thermofusing resin with the thermal bonding property has a melting point of not more than the melting point of the sintered PTFE, that is, less than about 327° C., and a melt viscosity at least around 320° C. of not more than about $1\times10^6$ poises. Examples thereof may be, for instance, fluorine-containing thermofusing resins such as tetrafluoroethylene-perfluoro(alkyl vinyl ether) copolymer (PFA), tetrafluoroethylene-hexafluoropropylene copolymer (FEP), ethylene-tetrafluoroethylene copolymer (ETFE), ethylene-chlorotrifluoroethylene copolymer (ECTFE), polychlorotrifluoroethylene (PCTFE), polyvinylidene fluoride (PVdF) and polyvinyl fluoride (PVF); general-use resins such as polyethylene (PE), polypropylene (PP), polybutylene terephthalate (PBT) and polyethylene terephthalate (PET) and the like. Among them, the fluorine-containing thermofusing resins are preferable. PFA and FEP are more preferable from the viewpoint of good adhesion to PTFE when stretching at a temperature of not less than the melting point, and PFA is particularly preferable from the viewpoint of good heat resistance.

The melting point of the above-mentioned thermofusing resins is preferably from 100° C. to 320° C., particularly from 230° C. to 310° C. from a point that the thermofusing resins are not thermal-decomposed, because PTFE is stretched at relatively high temperature (not more than the melting point of PTFE).

The thickness of the layer or film comprising the above-mentioned thermofusing resin is not more than 50 μm, preferably not more than 25 μm, particularly preferably not more than 12.5 μm. If the thickness is more than 50 μm, there is a tendency that a trouble such as entangling of the film on the needles of the needle blade rolls in the splitting or slitting step occurs.

In the present invention, the thermal bonding property of the above-mentioned thermofusing resin is utilized. The thermal bonding property is a property capable of thermally bonding the PTFE fiber provided with a layer or film comprising the thermofusing resin on at least a part of the surface of the PTFE film, via the thermofusing resin. The thermal bonding property can be obtained when the resin is melted at a temperature lower than about 327° C. and has a melt viscosity of not more than about $1\times10^6$ poises at around 320° C.

The above-mentioned thermofusing resin layer may be provided on at least a part of the surface of the PTFE film, and may be one enabling the stretching to be conducted by heating at a temperature of not less than the melting point of the thermofusing resin in the uniaxial stretching step without causing peeling off of the thermofusing resin from the PTFE film.

Various non-woven fabrics obtained from the above-mentioned cotton-like mixed materials are suitably used as filtrating material for liquid, filtrating material for dust collection, heat resisting electromagnetic wave shielding material, insulating material, hydrophobic sheet-like material, sealing material such as gasket or packing, sound absorbing material, noise suppressing material, material for absorbing and retaining liquid, liquid supplying material for gradually releasing said retained liquid and the like.

The present invention is explained by means of Examples, but is not limited thereto.

EXAMPLE 1 to 6

The PTFE fine powder (Polyflon F104U available from Daikin Industries, Ltd.) was mixed with a liquid lubricant (IP-2028, available from Idemitsu Kagaku Kabushiki Kaisha), and then aging was done at room temperature for 2 days and a compression-preforming was conducted to make a block. Then paste-extrusion, calendering and then drying of the lubricant by heating were conducted by using the preformed block to make an unsintered film.

The unsintered film was heat-treated for 60 seconds in a salt bath heated to 360° C. to give a sintered film having a width of 160 mm and thickness of 60 μm.

The sintered film was stretched by 4 times in the longitudinal direction by means of two rolls heated to 320° C. and having different rotation speeds by using the above-mentioned equipment shown in FIG. 1, followed by heat-setting treatment (annealing) by means of a roll heated to 340° C., and thus the uniaxially stretched film of 85 mm wide and 22 μm thick was obtained.

The uniaxially stretched film was split by means of a pair of upper and lower needle blade rolls as shown in FIG. 2 at a film feed speed (V1) of 5 m/min, and a peripheral speed (V2) of 25 m/min. of the needle blade rolls with a speed ratio of V2/V1 of 5 times.

The shape of the needle blade rolls, and the arrangement and engagement of the blades of the upper and lower needle blade rolls are as mentioned below. When the film 30 was passed at the same speed as a rotation of a pair of upper and lower needle blade rolls 7 and 8 of FIG. 2, the punched film as shown in FIG. 3 was obtained. In FIG. 3, A is a needled hole of the upper needle blade roll 7, and the pitch P1 of the holes in the circumferential direction was 2.5 mm. B is a needled hole of the lower needle blade roll 8, and the pitch P2 thereof was 2.5 mm just like P1. The number "a" of needles in the longitudinal direction of the roll was 13 per 1 cm. Also as shown in FIG. 4, the angle (θ) of the needle to the film 6 being fed between the rolls 7 and 8 was so set as to be an acute angle (60°). As it can be seen from FIG. 3, the upper and lower needle blade rolls 7 and 8 were so set that the needles of the upper and lower rolls were arranged alternately in the circumferential direction of the rolls. The length of the needle blade rolls was 250 mm, and the diameter of the rolls was 50 mm at the needle point thereof.

The obtained split yarns are in the form of network structure shown in FIG. 5, and the fineness thereof was about 35,000 deniers (rounded to thousands).

A continuous filament tow comprising the PTFE split yarns and the other fibers was fed to the needle blade rolls rotating at high speed through the nip rolls in the mixing amounts shown in Table 1. Downstream of air stream in an air duct disposed at the rear side of the needle blade rolls, in which there are direct air flow and convection air flow, there is provided a mesh (FIG. 6) to pile the cotton-like mixed materials comprising nearly evenly the PTFE fibers (FIG. 7) having branches and the other fibers which have been cut by means of the needle blade rolls. With respect to those cotton-like mixed materials, the tests mentioned hereinafter were conducted. The results are shown in Table 1.

The deposited cotton-like mixed materials were subjected to water jet needling to intermingle the fibers with each other to give non-woven fabrics. Then the tests mentioned hereinafter were conducted. The results are shown in Table 1.

A water jet needling equipment is one available from Perfojet Co., Ltd. In that case, the nozzles of the water jet needle were so arranged that 800 nozzles having a 100 μm diameter were set at intervals of 1 mm in the transverse direction and at three rows in the longitudinal direction. The ejection pressure was 40 kg/cm$^2$, 100 kg/cm$^2$ and 130 kg/cm$^2$ at the first, second and third rows, respectively. The transfer speed was 10 m/min.

The tests were made in the following manner. About a hundred pieces of fibers were sampled for the tests.

(Fiber Length and Number of Branches)

The fiber length and the number of branches (including loops) were measured by using about a hundred pieces of PTFE fibers sampled at random.

(Fineness)

About a hundred pieces of fibers sampled at random were used to measure the fineness thereof with an electronic fineness measuring apparatus (available from Search Co., Ltd.) which utilizes a resonance of the fiber for measurement. The maximum and minimum figures measured are shown in FIG. 1.

The apparatus could measure the fineness of the fibers having the length of not less than 3 cm, and the fibers were selected irrespective of trunks or branches. But the fibers having, on the length of 3 cm, a large branch or many branches were excluded because they affects the measuring results. The apparatus is capable of measuring the fineness in the range of 2 to 70 deniers, and so the fibers having the fineness less than 2 deniers were excluded because measurement is difficult.

(Number of Crimps)

Measurement was made in accordance with the method of JIS L 1015 by means of an automatic crimp tester available from Kabushiki Kaisha Koa Shokai with about a hundred pieces of fibers sampled at random (The crimps on the branch were not measured). The maximum and minimum figures measured are shown in FIG. 1.

(Weight Per Unit Area)

The weight per unit area of non-woven fabrics was obtained based on measurement with a 100 cm$^2$ fabric sampled. The obtained figures were rounded to tens.

(Thickness)

The thickness was measured with the sample used for measuring the weight per unit area and having a diameter of measured portion of 10 mm, by means of a thickness meter available from Mitsutoyo Kabushiki Kaisha.

(Strength)

The fiber was cut to have a width of 25 mm in the transfer direction of the water jet needles, and measurement was made by applying tension at a rate of 200 mm/min.

(Electric Conductivity)

The resistance was measured between the two points apart by 5 cm from each other on the surface of a non-woven fabric by using a tester.

TABLE 1

| | Examples | | | | | | | | | | | |
|---|---|---|---|---|---|---|---|---|---|---|---|---|
| | 1 | | 2 | | 3 | | 4 | | 5 | | 6 | |
| PTFE fiber (part by weight) | 100 | | 100 | | 100 | | 100 | | 100 | | 100 | |
| Kind of other fibers (part by weight) | Meta-linked type aramid fiber 65 | | Garbon fiber 20 | | Stainless stee1 fiber 40 | | Stainless steel fiber 80 | | Glass fiber 20 | | Wool 75 | |
| Based on 100 pieces of short PTFE fibers | | | | | | | | | | | | |
| Number of branches (per 5 cm) | 1 to 11 | | 1 to 12 | | 1 to 8 | | 1 to 12 | | 1 to 7 | | 1 to 13 | |
| Number of crimps (per 20 mm) | 1 to 7 | | 1 to 5 | | 1 to 6 | | 1 to 6 | | 1 to 5 | | 1 to 6 | |
| Fineness (denier) | 2 to 43 | | 2 to 48 | | 2 to 45 | | 2 to 42 | | 2 to 48 | | 2 to 43 | |
| Fiber length distribution | Meta-linked aramid fiber | PTFE fiber | Carbon fiber | PTFE fiber | Stainless steel fiber | PTFE fiber | Stainless steel fiber | PTFE fiber | Glass fiber | PTFE fiber | Wool | PTFE fiber |
| Less than 5 mm (%) | 0 | 0 | 2 | 0 | 1 | 0 | 0 | 0 | 2 | 0 | 0 | 0 |
| Less than 25 mm (%) | 2 | 8 | 18 | 14 | 16 | 15 | 5 | 11 | 11 | 12 | 15 | 9 |
| Less than 75 mm (%) | 95 | 87 | 78 | 84 | 82 | 82 | 92 | 85 | 86 | 85 | 80 | 89 |
| Not less than 75 mm (%) | 3 | 5 | 2 | 2 | 1 | 3 | 3 | 4 | 1 | 3 | 5 | 2 |
| Conditions of non-woven fabrics | | | | | | | | | | | | |

TABLE 1-continued

| | Examples | | | | | |
|---|---|---|---|---|---|---|
| | 1 | 2 | 3 | 4 | 5 | 6 |
| Weight (g/m$^2$) | 400 | 480 | 520 | 600 | 500 | 400 |
| Thickness (mm) | 1.6 | 1.4 | 1.5 | 1.8 | 1.5 | 1.7 |
| Strength (g-cm) | 4300 | 1700 | 2800 | 1900 | 1800 | 3200 |
| Characteristics | Water becomes water droplets on fabrics. | Fabrics have electric conductivity. | Fabrics have electric conductivity. | Fabrics have electric conductivity. | Water becomes water droplets on fabrics. | Water becomes water droplets on fabrics. |
| Electric conductivity (Ω) | — | 250 | 50000 | 500 | — | — |

The other fibers in Table 1, which were mixed with the PTFE fibers, are as follows. Meta-linked aramid fiber:

Aramid fiber "CORNEX" (tradename) available from Teijin Ltd. and having fineness of 2 deniers per one filament was used.

Carbon Fiber:

Carbon fiber "TORAYCA (tradename) Type T300C" (a tow of 8,000 deniers) available from Toray Co., Ltd. was used.

Stainless Steel Fiber:

"SUSMIC fiber (tradename) Type 304" (a tow of 2,500 deniers) available from Tokyo Steel Co., Ltd. was used.

Glass Fiber:

Glass fiber (one filament: 3 μm ) available from Nitto Boseki Kabushiki Kaisha was used.

Wool:

Sliver comprising American merino wool and having an average fineness of 3 deniers was used.

EXAMPLE 7

Cotton-like mixed materials were produced in the same manner as in Example 1 by using the PTFE split yarn obtained in Example 1 and a tow of polypropylene, i.e. a thermofusing resin having fineness of 1 denier per one filament. Subsequently the obtained cotton-like mixed materials were made into a sheet-like non-woven fabric by means of a calender roll heated to 170° C., then the following tests were conducted. The results are shown in Table 2.

(Tensile Strength)

The non-woven fabric was cut to have a width of 25 mm in the same direction as the rotation direction of the calender roll, and measurement was made by applying tension at a rate of 200 mm/min.

(Falling of Fibers)

An adhesive tape was applied, and adhesion of fibers to the tape was observed.

EXAMPLE 8

A FEP film (NEOFLON FEP film available from Daikin Industries, Ltd.) was laminated on one side of the PTFE film obtained in Example 1, the laminated film was stretched by four times between rolls at a temperature of not less than a melting point of FEP, i.e. 280° C., and then a split yarn was produced in the same manner as in Example 1. Then, cotton-like mixed materials were made in the same manner as in Example 1 by using the obtained split yarn and the PTFE split yarn produced in Example 1, and subsequently a sheet-like non-woven fabric was obtained from the cotton-like mixed materials by means of a calender roll heated to 300° C., then the same tests as in Example 7 were conducted. The results are shown in Table 2.

EXAMPLE 9

Cotton-like mixed materials and a non-woven fabric were produced in the same manner as in Example 7 except that the uniaxially stretched film was not split. The same tests as in Example 7 were conducted. The results are shown in Table 2.

TABLE 2

| | Examples | | |
|---|---|---|---|
| | 7 | 8 | 9 |
| PTFE fiber (part by weight) | 100 | 100 | 100 |
| Mixing amount of other fibers (part by weight) | 100 | 100 | 100 |
| Weight (g/m$^2$) | 100 | 300 | 100 |
| Thickness (μm) | 200 | 250 | 200 |
| Tensile strength (rolling direction) [g (1 cm wide)] | 1300 | 800 | 1200 |
| Shape | Paper-like | Paper-like | Paper-like |
| Water-repelling property (dropped water) | Water droplets | Water droplets | Water droplets |
| Air permeability | Good | Good | Good |
| Falling of fibers | None | None | None |

INDUSTRIAL APPLICABILITY

As is clear from the above-mentioned results, the cotton-like mixed materials of the present invention contain PTFE fibers having the branched structure and/or loop structure, and therefore are excellent in intermingling property with other various fibers, and the non-woven fabrics obtained therefrom have excellent properties inherent to the PTFE fibers and good properties which the other fibers have.

Also the process for producing the cotton-like mixed materials of the present invention can produce effectively the above-mentioned cotton-like mixed materials excellent in intermingling property.

Further the process for producing the felt-like non-woven fabrics of the present invention is capable of intermingling the fibers including the PTFE fibers by needle punching or water jet needling.

Further the process for producing the non-woven fabrics of the present invention which are less in falling of fibers, can provide non-woven fabrics excellent in thermal bonding property.

We claim:

1. Cotton-like mixed materials comprising polytetrafluoroethylene fibers having branched structure and/or loop structure and other fibers.

2. The cotton-like mixed materials of claim 1, wherein the mixing amount of said other fibers is from 10 to 90% by weight.

3. The cotton-like mixed materials of claim 1, wherein said other fibers comprise at least two kinds of fibers.

4. The cotton-like mixed materials of claim 1, wherein said other fibers are inorganic fibers.

5. The cotton-like mixed materials of claim 4, wherein said inorganic fibers are carbon fibers, glass fibers and/or metal fibers.

6. The cotton-like mixed materials of claim 1, wherein said other fibers are heat resistive synthetic fibers.

7. The cotton-like mixed materials of claim 6, wherein said heat resistive synthetic fibers are poly(phenylene sulfide) fibers, polyimide fibers, para-linked aramid fibers, meta-linked aramid fibers, phenolic fibers, polyalylate fibers and/or carbide fibers.

8. The cotton-like mixed materials of claim 6, wherein said heat resistive synthetic fibers are fluorine-containing resin fibers including tetrafluoroethylene-perfluoro(alkyl vinyl ether) copolymer fibers, tetrafluoroethylene-hexafluoropropylene copolymer fibers, ethylene-tetrafluoroethylene copolymer fibers, poly(vinyl fluoride) fibers, poly(vinylidene fluoride) fibers, polychlorotrifluoroethylene fibers and/or ethylene-chlorotrifluoroethylene copolymer fibers.

9. The cotton-like mixed materials of claim 1, wherein said other fibers are polyolefin fibers including polyethylene fibers and/or polypropylene fibers.

10. The cotton-like mixed materials of claim 1, wherein said other fibers are polyester fibers including polyethylene terephthalate fibers and/or polybutylene terephthalate fibers.

11. The cotton-like mixed materials of claim 1, wherein said other fibers are natural fibers.

12. The cotton-like mixed materials of claim 1, wherein said polytetrafluoroethylene fibers are provided with thermofusing resin layer on at least a part of the surface thereof.

13. Non-woven fabrics obtained from the cotton-like mixed materials of claim 1.

14. A process for production of cotton-like mixed materials, characterized in that a continuous filament tow other than PTFE fibers, a sliver in spinning step or at least two thereof and a polytetrafluoroethylene film uniaxially stretched by at least three times or a split yarn made by splitting said uniaxially stretched film into net-like form are fed simultaneously to needle blade rolls which rotate at high speed.

15. The process of claim 14, characterized in that said polytetrafluoroethylene film is provided with thermofusing resin layer on at least a part of the surface thereof and said uniaxial stretching is conducted at a temperature of not less than a melting point of the thermofusing resin.

16. The process of claim 15, characterized in that said thermofusing resin layer is provided by laminating a thermofusing resin film.

17. A process for production of felt-like non-woven fabrics, characterized in that fibers in the cotton-like mixed materials obtained by the process of claim 14 are intermingled by needle punching or water jet needling.

18. A process for production of non-woven fabrics which are less falling of fibers, characterized in that a part of fibers in the cotton-like mixed materials obtained by the process of claim 15 which contain thermofusing resin is subjected to thermal bonding.

* * * * *